United States Patent [19]

Benedyk

[11] 4,258,094

[45] Mar. 24, 1981

[54] MELT BONDED FABRICS AND A METHOD FOR THEIR PRODUCTION

[75] Inventor: Joseph C. Benedyk, Highland Park, Ill.

[73] Assignee: Brunswick Corporation, Skokie, Ill.

[21] Appl. No.: 33,462

[22] Filed: Apr. 26, 1979

[51] Int. Cl.[3] ..... B32B 3/00

[52] U.S. Cl. ..... 428/85; 28/112; 156/72; 156/148; 264/126; 264/112; 428/95; 428/296; 428/297; 428/298; 428/299; 428/300; 427/206; 427/389.9

[58] Field of Search ..... 156/62.2, 62.4, 72, 156/148, 306, 279, 324; 264/122, 126; 428/85, 95, 288, 296, 298, 299, 300; 28/112; 418/284, 287

[56] References Cited

U.S. PATENT DOCUMENTS

| | | | |
|---|---|---|---|
| 2,331,321 | 10/1943 | Heaton | 156/62.2 |
| 2,464,301 | 3/1949 | Francis | 156/220 |
| 3,801,428 | 4/1974 | Striegler et al. | 428/296 |

*Primary Examiner*—James J. Bell

*Attorney, Agent, or Firm*—John G. Heimovics; William G. Lawler, Jr.

[57] ABSTRACT

A melt bonded fabric is produced by blending particular ethylene-vinyl acetate fibers with fibers of higher melting materials, forming a fabric thereof as by needle punching, and thereafter subjecting the fabric to temperatures above the melting point of ethylene-vinyl acetate but below that of the other fibers in the fabric.

34 Claims, 6 Drawing Figures

MELT BONDED FABRICS AND A METHOD FOR THEIR PRODUCTION

CROSS-REFERENCES TO RELATED APPLICATIONS

This application is related to the copending U.S. Pat. No. 4,181,762 of Joseph C. Benedyk, entitled "Fibers, Yarns and Fabrics of Low Modulus Polymer".

BACKGROUND OF THE INVENTION

This invention relates generally to the production of fabrics containing at least two different fibers, one having a melting point substantially below that of the other.

More specifically, this invention relates to fabrics having incorporated therein particular ethylenevinyl acetate fibers in an amount sufficient to lock other fibers into place and to provide dimensional stability to the fabric upon heating it to a temperature above the melting point of ethylene-vinyl acetate.

DISCUSSION OF THE PRIOR ART

The concept of melt bonding fabrics by incorporating therein a low melting point thermoplastic fabric has long been known. For example, U.S. Pat. No. 2,331,321 discloses blending thermoplastic fibers with non-thermoplastic fibers to form a fabric which is subjected to heating whereby the thermoplastic fiber is melted to bond other fibers within the fabric. Cellulose acetate was disclosed as a preferred thermoplastic fiber and other thermoplastics including vinyl chloride and vinyl acetate were suggested as being appropriate for use.

The Ballard Patent, U.S. No. 3,940,525, proposed the use of ethylene-vinyl acetate polymeric compositions for use as a hot melt adhesive backsizing for tufted carpets. Elastomeric fibers comprising an ethylene-vinyl acetate copolymer are also known as is disclosed in German Pat. No. 1,278,689. Copolymers used have a vinyl acetate content of 40 to 45% and fibers are spun from a solution of the polymer in a solvent such as methylene chloride. Elastic modulus of the fibers produced by the process of the German Patent is about 0.08–0.09 $Kp/mm^2$ which, in English units, is about a 120–130 psi.

Vinyl chloride/vinyl acetate copolymer fibers, known generically as vinyon fibers, display good resistance to chemicals and bacteria, are unaffected by water and sunlight, and have a low softening point. This combination of properties has resulted in the extensive use of vinyon fibers in melt bonding fabrics. However, there are two major disadvantages associated with the use of vinyon fibers for this purpose. Because they contain chloride, vinyon fibers are self-extinguishing but overheating results in dechlorination with a liberation of hydrogen chloride gas. Hydrogen chloride is an extremely irritating and corrosive gas and its release by the charring of carpeting or other fabrics containing vinyon fibers increases the hazards of a fire considerably. A second disadvantage to the use of vinyon fibers in melt bonded fabrics is economic in nature. As vinyon fibers are relatively quite expensive, melt bonded fabrics containing vinyon fibers are generally not competitive with other types of fabrics.

SUMMARY OF THE INVENTION

I have found that fibers suitable for use in making melt bonding fabrics such as carpeting may be manufactured of certain ethylene-vinyl acetate resins heretofor considered completly unsuited for such use provided that certain criteria are met. The ethylene-vinyl acetate must have a elastic modulus in the range of about 5,000 to about 60,000 psi and an ultimate tensile strength above about 2,000 psi and preferably in the range of about 5,000 to 20,000 psi.

The fibers may be produced in monofilament form by extrusion through an orifice and preferably have a diameter in the range of about 3–6 mils or a denier of from about 25 to 150. It is preferred that the fibers display an area moment of inertia from $400\times10^{-14}$ to $7{,}000\times10^{-14}$ $in^4$ and a stiffness parameter of about $1\times10^{-5}$ to $1\times10^{-8}$ $lb\text{-}in^2$. Melting point of the fibers may range from about 90° to 120° C. and preferably between about 95° and 120° C.

Melt bonded fabrics are produced by blending ethylene-vinyl acetate fibers with fibers of higher melting point thermoplastics such as polypropylene or nylon, formed as by needle punching into a web and subsequently exposing the web to temperatures which melt the ethylene-vinyl acetate but do not affect the fibers of the other thermoplastic.

Hence it is an object of my invention to provide melt bonded fabrics.

It is another object of my invention to provide non-woven pile fabrics of a relatively high melting point thermoplastic fiber bonded by fused fibers of ethylene-vinyl acetate.

A specific object of my invention is to provide low-cost high quality pile fabrics suitable for use as carpeting.

GENERAL DISCUSSION OF THE INVENTION

Non-woven fabrics made by needle punching and similar techniques have two major disadvantages as compared to woven fabrics. First, the fabric is not dimensionally stable and is subject to stretching and uneven elongation. Second, the individual fibers making up the fabric are not securely locked into place and can be easily pulled from the fabric.

Many needle punched fabrics are built on a scrim which improves the dimensional stability of the resultant fabric but does not contribute to fiber locking within the fabric. Heavy non-woven fabrics, such as those used as carpeting, typically employ an adhesive coating on the fabric back to hold the fibers, or pile from being pulled out. Backsizing agents such as latex adhesives are commonly used for this purpose and the backsizing adhesive contributes to the dimensional stability of the fabric.

The melt bonded fabric of this invention provides a material having a high degree of dimensional stability in which individual fibers are locked into the fabric by fusion bonding. When used as carpeting, my melt bonded fabric offers significant advantages as compared to conventional carpeting materials. Backsizing adhesives are eliminated as are the process steps of applying adhesives or secondary backing materials. The back surface of the carpet is attractive in appearance and cannot stick to, or transfer to, the face of the carpet when rolled up. In addition to cost savings in the process steps of fabric manufacture, cost of the ethylene-vinyl acetate fibers used in my invention is substantially less than that of conventional carpet fibers.

In one embodiment of my invention, chopped, staple length fibers of ethylene-vinyl acetate are blended with staple fibers of a higher melting point polymer such as polypropylene or nylon and formed into needle punched nonwoven fabrics. The fabrics are then exposed to temperatures which melt the ethylene-vinyl acetate fibers but do not affect the other fibers in the fabric. The proportion of ethylene-vinyl acetate to higher melting fiber may range from about 5:95 to 50:50.

In another embodiment of my invention, a finished needle bonded web of high melting point fibers is first produced. Thereafter, a web of ethylene-vinyl acetate fibers is laid on the back of the finished web and is again needled. The composite web is then heated to a temperature above the melting point of ethylene-vinyl acetate producing a melt bonded fabric having a smooth, finished back appearance.

In yet another embodiment of my invention, ethylene-vinyl acetate staple fibers may be needled together to form a scrim. Thereafter, a layer of higher melting point fibers is deposited on top of the scrim and needled thereto. Heating this composite web as previously described results in a finished, melt bonded fabric.

DETAILED DESCRIPTION OF THE INVENTION

Figure 1:
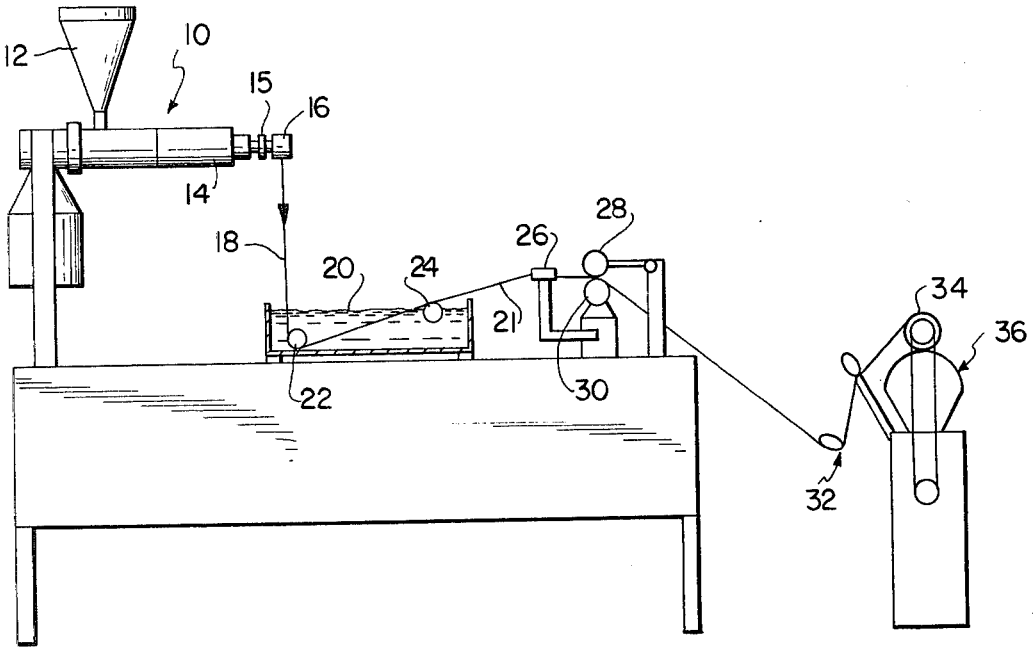
FIG. 1 is a side elevational view of an extruder and draw line used in spinning the melt bonding fiber of my invention.

Referring first to FIG. 1, there is shown a preferred method of making the fibers of my invention. Ethylene-vinyl acetate having the proper elastic modulus is extruded into a plurality of monofilaments using a conventional extruder 10 as is described in a paper presented by D. Poller and O. L. Riedly, "Effect of Monofilament Die Characteristics on Processability and Extrudate Quality", 20 Annual SPE Conference, 1964, paper XXII-2. Extruder 10 includes a hopper 12 into which pellets of ethylene-vinyl acetate are loaded, and an extruder barrel 14 where the pellets are melted, a static mixer 15, and a spinnerette plate 16 through which the molten polymer is extruded.

The melted polymer leaves the spinnerette plate 16 as a plurality of molten strands 18 which are led downwardly into a quenching water bath 20 maintained at a temperature in the range of ambient to about 150° F. The molten polymer strands are chilled rapidly in the bath 20 and solidified to form continuous monofilament fibers 21. Fibers 21 pass around a pair of guides 22 and 24 and through a guide plate 26 into the nip of a pair of rollers 28 and 30. The speed of rollers 28 and 30 are set to pull onthe fiber strands 18 so that each strand has a diameter of about 6 to about 15 mils and preferably from about 7 to 9 mils. After leaving rollers 28 and 30, the solid monofilaments passed through a fiber guide-braking system 32 and are wound about spools 34 mounted on winder 36.

Figure 2:
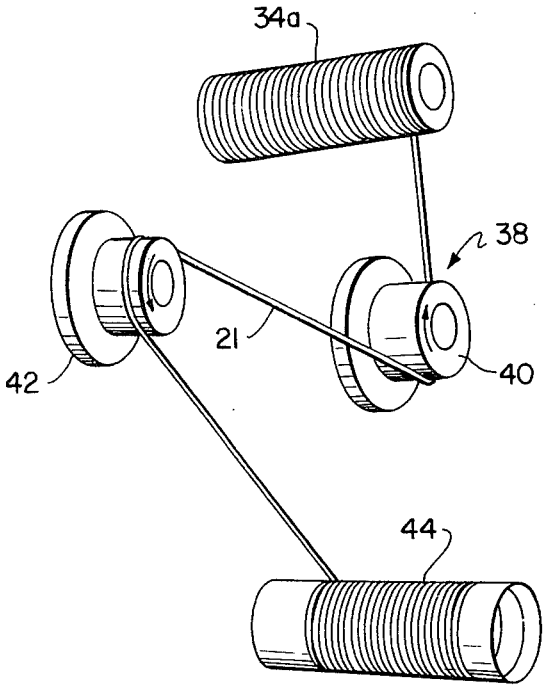
FIG. 2 illustrates a draw-winding apparatus for stretching the extruded fiber.

Turning now to FIG. 2, there is shown the drawing of monofilaments in the solid state. This solid state drawing is performed at a temperature below about 100° F. and reduces the diameter of the extruded monofilaments from about 6 to 15 mils to about 3 to 6 mils. A spool 34*a*, loaded with multiple strands of monofilaments, is removed from winder 36 of FIG. 1 and placed on the draw winding apparatus of 38. The lead ends of the fibers 21 on spool 34*a* are unwound, guided about two drawing godets 40 and 42, and wrapped around a second spool 44. Godets 40 and 42 turn at different angular velocities so that the fibers 21 coming off spool 34*a* are stretched or drawn.

Because the monofilament fibers of my invention are produced by extrusion through a spinnerette having relatively large orifices typically having a diameter in the range of about 10 to 30 mils, it is possible to incorporate within the fiber a relatively high loading of solid fillers without plugging the spinnerette plate. This allows incorporation of pigments, solid fillers, and certain solid flame or fire retardants. Particle size of the solid additives may generally range from about 1 to 25 microns. Total solids loading in the fiber may range as high as 20%. Exemplary solid fillers include calcium silicate, aluminum silicate, carbon black and alumina.

As ethylene-vinyl acetate may be extruded into monofilaments at relatively low temperatures, typically below 500° F., it is possible to incorporate within the fiber certain solid flame or fire retardants which decompose at relatively low temperatures. A particularly preferred solid fire retardant is finely divided hydrated magnesia. As is well known in the art, hydrated magnesia is a low cost, highly effective fire retardant but one which can not be used in polymers extruded at high temperature.

Figure 3:
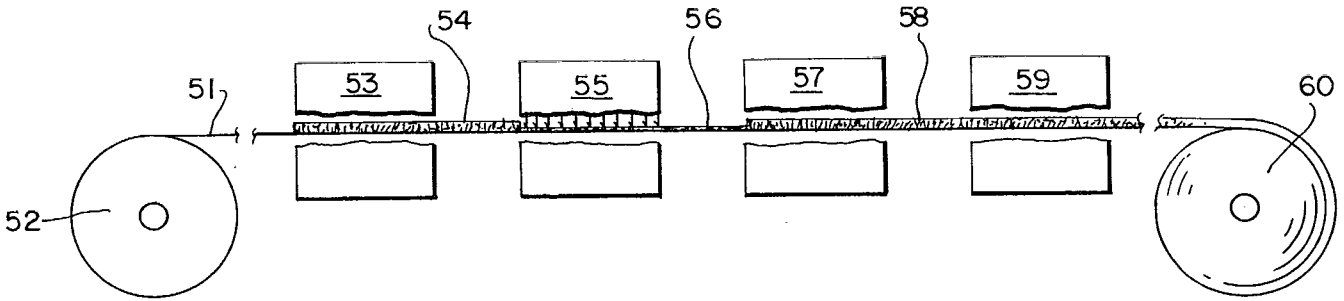
FIG. 3 is a schematic representation of a method for making melt bonded fabrics according to my invention.

Turning now to FIG. 3, there is illustrated a preferred method of manufacturing a pile fabric suitable for use as carpeting in accordance with my invention. As the apparatus used in this method of fabric manufacture are well known to the art, they have been shown only in block form and will not be described in detail.

The fabric may be built on a scrim 51 fed from a supply roll 52. The scrim may comprise any of the conventional woven or non-woven types including jute, burlap, woven and non-woven polymeric fiber webs and the like. A conventional lapper 53 is then used to deposit a uniform web or batt of garnetted staple fibers 54 on the upper or face surface of scrim 61. Fibers 54 may comprise ethylene-vinyl acetate in staple length of about 1 to about 4 inchs or may comprise a mixture of staple fibers of ethylene-vinyl acetate with staple fibers of other compositions including nylon, polypropylene and the like.

The scrim carrying a fiber batt is then passed through a needle loom 55, such as the standard Dilo loom, which needle bonds the fiber layer to the scrim to form a fabric subface 56. Thickness and density of subface 56 may by varied as desired by controlling the amount or thickness of staple fibers deposited by lapper 53 and by varying the needle density of loom 55.

After needle bonding, subface 56 may optionally be subjected to a second, or texture needling operation using a texturing loom 57. The patterning or arrangement of needles on loom 57 can be varied to produce a patterned pile surface having the appearance of conventional tufted or woven carpets.

The ethylene-vinyl acetate fibers used in my invention display a melting point generally within the range of 90° to 125° C. depending upon their vinyl acetate content. Melting points of ethylene-vinyl acetate fibers increase as the vinyl acetate content decreases. It is preferred to limit the vinyl acetate content to a range between about 5% and 20% as a vinyl acetate content below about 5% displays too high a melting point and a vinyl acetate content above about 20% tends to have an undesirably low melting point and elastic modulus. In contrast, polypropylene fibers typically display a melting point of about 165° C. while most nylons display a melting point above about 215° C.

After processing, the formed pile fabric is passed through melt bonding means 59. Means 59 may comprise one or more pairs of fusion rollers or may comprise a pair of closely spaced endless belts as is illustrated in more detail in FIGS. 4 and 5. During its passage through melt bonding means 59, the fabric is heated to a temperature whereat the ethylene-vinyl acetate fibers melt to form a fusion bond locking the higher melting point thermoplastic fibers into the fabric. After fusion bonding, the fabric is wound onto a roll 60 for storage and transport.

In another embodiment of my invention which may also be described in relation to FIG. 3, a web or batt of ethylene-vinyl acetate staple fibers is laid on the back of a finished, needle-bonded fabric consisting of relatively high melting point thermoplastic fibers such as nylon or polypropylene. In this embodiment, the needle-bonded fabric 51 is fed from a supply roll 52 and is passed to lapper 53. A batt of garnetted staple ethylene-vinyl acetate fibers 54 are laid on the back surface of fabric 51. The fabric, now carrying a fiber batt, is passed through needle loom 55 which needle bonds the fiber layer to the fabric back. The composite fabric 56 is then passed directly to fusion bonding means 59 wherein the fabric is subjected to heating at a temperature sufficient to cause fusion of the ethylene-vinyl acetate fibers making up the fabric backing. As before, the finished fusion bonded fabric is wound onto a roll 60 for storage or transport.

In yet another embodiment of my invention, there is first formed a needle-bonded scrim of ethylene-vinyl acetate fibers upon which is laid a batt or web of high melting point thermoplastic fibers which are needled to the scrim. Describing this embodiment, again in relation to FIG. 3, a previously prepared needle-bonded scrim of ethylene-vinyl acetate staple fibers 51 is fed from supply roll 52. Lapper 53 then is used to deposit a uniform batt of garnetted staple fibers of nylon, polypropylene, or like materials 54 on the surface of scrim 51.

The ethylene-vinyl acetate scrim, now carring a batt of higher melting point thermoplastic fibers, is passed through needle loom 55 which needle bonds the fiber layer to the scrim to form a fabric subface 56. Fabric 56 is then passed through processing device 57 which may comprise a texturing needle loom which creates a textured pattern on the fabric face.

After needle texturing, the fabric is passed through fusion bonding means 59. As before, means 59 subjects the fabric to a temperature sufficient to melt and fuse the ethylene-vinyl acetate fibers without softening or thermally degrading the other fibers contained in the fabric. After fusion bonding, the fabric is wound upon roll 60.

Figure 4:
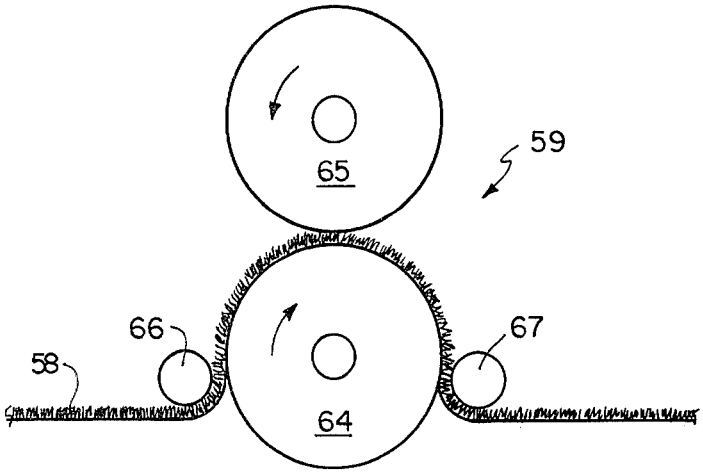
FIG. 4 depicts one technique for melt bonding the fabrics of my invention.

Referring now to FIG. 4, there is shown one embodiment of fusion bonding means 59. Fabric 58 is passed through the nip of a pair of rolls 64 and 65. Roll 64 is heated to and maintained at a temperature above the melting point of ethylene-vinyl acetate but substantially below the melting point of the other fibers making up fabric 58. Guide rolls 66 and 67 control the degree of wrap around heated roll 64. Roll 65 is preferably unheated and its surface may comprise a layer of resilient material such as rubber. Roll 65 may be spring loaded to maintain a preset degree of pressure on the top side of fabric 58. As fabric 58 passes over heated roll 64, the ethylene-vinyl acetate fibers contained therein melt and upon later cooling firmly bond the other fibers within the fabric. Fusion bonding also imparts dimensional stability to the finished fabric and produces a finished back surface of pleasing appearance.

Figure 5:
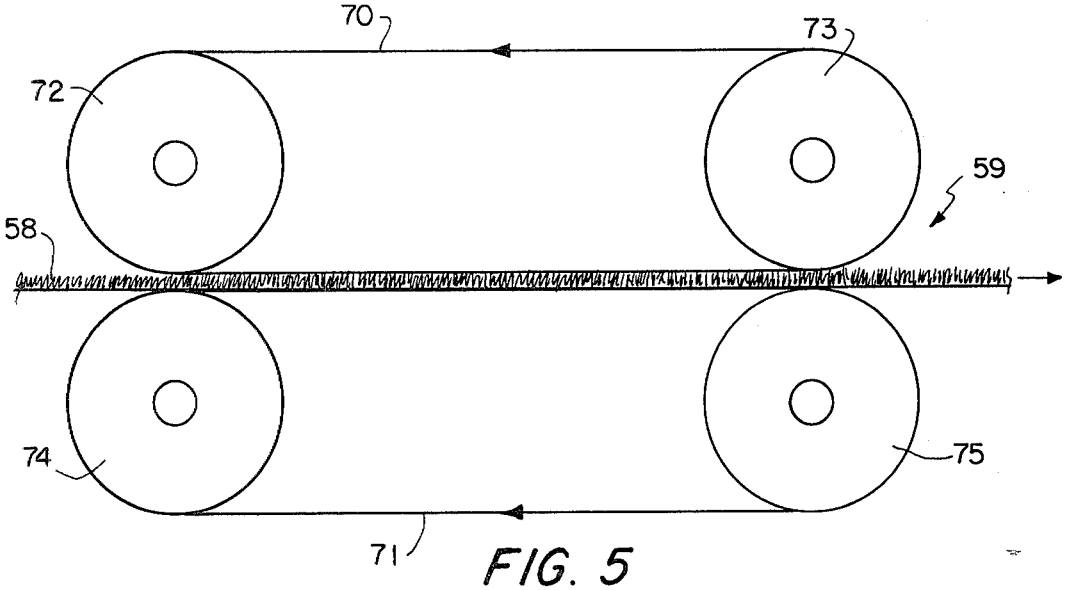
FIG. 5 depicts an alternative means for accomplishing the melt bonding step.

Alternatively, fusion bonding means 59 may comprise a pair of closely spaced endless belts as is illustrated in FIG. 5. Fabric 58 is passed between upper belt 70 and lower belt 71 as is illustrated. Upper belt 70 travels around rolls or pulleys 72 and 73 while lower belt 71 is similiarly arranged about pulleys 74 and 75. One of the belts, preferably lower belt 71, is heated by any appropriate means to a temperature above the melting point of ethylene-vinyl acetate but below the melting point of other fibers contained in the fabric. As the fabric 58 passes between the belts, the ethlene-vinyl acetate fibers are melted to form a fusion bonded fabric.

Figure 6:
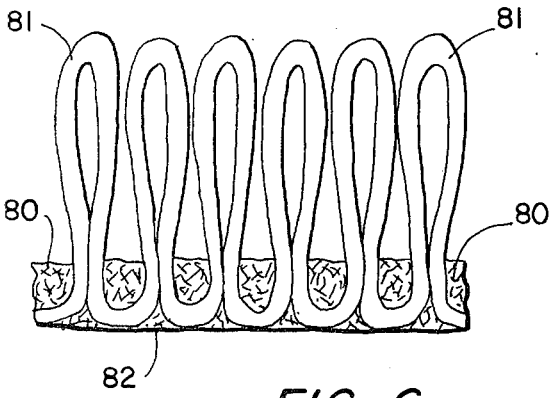
FIG. 6 is a fragmentary view in cross-section illustrating a typical fabric formed according to my invention.

FIG. 6 illustrates a fragmentary cross-sectional view of a pile fabric made by the process of my invention. A subface layer 80 comprising a melt bonded fabric produced as described previously has tufted through it loops of yarn 81 to develop a fabric face comprising yarn tufts 81 which typically extend at least ⅛ inch or more above the subface layer. Tufts 81 may be of the looped type as is shown or may be cut or sheared. Yarn tufts 81 may comprise conventional carpet fibers such nylon and polypropylene or may comprise fibers of ethylene-vinyl acetate as described in my copending U.S. Pat. No. 4,181,762. A backsizing adhesive 82, such as latex, is applied to the carpet back to lock the yarn tufts into place. As the melt bonded subface 80 provides a high degree of strength and dimensional stability, no other backing material is required.

In some instances, it is advantageous to further enhance the physical properties of the fabric by cross-linking the ethylene-vinyl acetate polymer after melt bonding. Cross-linking may be accomplished by irradiating the fabric with an electron beam. Radiation dosage should be sufficient to cross-link the polymer to give a gel content greater than 30% but less than 90%. In most cases, the preferred gel content is in the range of 45–55%. Gel content may be determined in conventional fashion by a solvent extraction in hot xylene.

Efficiency of radiation cross-linking is substantially enhanced by incorporating finely divided silicon dioxide or titnium dioxide within the polymer. Particle size of these oxides may range between about 100 angstroms and 1 micron and the amount used is generally below 1 volume percent. Ethylene-vinyl acetate polymers for example irradiated at a dosage of 10 megards (MR) will typically display a gel content of 25 to 28 percent. Irradiation of the same polymer containing 0.2 volume % silicon results in a gel content of about 40–45% at the same dosage level. Melting point of ethylene-vinyl acetate increases as the degree of cross-linking is increased. For this reason, cross-linking must be carried out after the melt bonding step has been performed.

The following example serves to more completely illustrate specific embodiments of my invention.

EXAMPLE

Several different ethylene-vinyl acetate formulations were extruded into monofilaments by the procedure described in relation to FIG. 1. The resin formulations used had the following physical properties.

TABLE

| Formulation | Melt Index | Vinyl Acetate Content | Melting Point °F. |
|---|---|---|---|
| NA 294 | 2.0 | 5 | 240 |
| UE 635 | 9.0 | 9 | Not determined |
| UE 643 | 9.0 | 19 | 198 |

The extruded and drawn fibers ranged from 80 to 120 denier which is equivalent to a diameter of 4.5 to 5.5 mils. The extruded and drawn monofilament was chopped into staple length fibers of approximately 3 inches in length.

The ethylene-vinyl acetate staple fibers were blended with 60 denier polypropylene staple fibers of 1.5 inches in length and needle punched to form non-woven fabrics having a weight of 20 oz/yd$^2$. The ratio of ethylene-vinyl acetate:polypropylene ranged from 5:95 to 50:50 on a weight basis.

Fabric samples were then heated to a temperature above the melting point of the ethylene-vinyl acetate but below the temperature at which polypropylene fibers melt. Stable and strong bonds were formed between the fused ethylene-vinyl acetate fiber matrix and the polypropylene fibers upon cooling the fabrics to room temperature. In all cases, the finished fabrics displayed excellent resilience as compared to adhesive bonding fabrics, were attractive in appearance, and were judged to have a good hand or feel.

I claim:

1. A method for making a melt bonded fabric which comprises blending ethylene-vinyl acetate fibers with fibers of a higher melting point polymer in a mat upon a scrim, needle punching said mat and scrim to form a web of said blended fibers and thereafter heating the web to a temperature above the melting point of ethylene-vinyl acetate but below the melting point of said higher melting point polymer.

2. The method of claim 1 wherein said ethylene-vinyl acetate fibers have an elastic modulus in the range of 5,000 to 60,000 psi.

3. The method of claim 2 wherein the ratio of ethylene-vinyl acetate fibers to higher melting point fibers ranges from 5:95 to 50:50.

4. The method of claim 3 wherein said higher melting point fiber is selected from the group consisting of polypropylene, polyamide and mixtures thereof.

5. The method of claim 3 wherein said higher melting point fiber is polypropylene.

6. The method of claim 3 wherein said higher melting point fiber is polyamide.

7. The method of claim 3 wherein the vinyl acetate content of said ethylene-vinyl acetate is in the range of 5 to 20%.

8. The method of claim 7 wherein said ethylene-vinyl acetate is cross-linked after melt bonding to the extent that the gel content is greater than 15% but less than 90%.

9. The method of claim 1 wherein said web is tufted with yarn of a higher melting point fiber after melt bonding.

10. The method of claim 1 wherein the vinyl acetate content of said ethylene-vinyl acetate is in the range of 5 to 20%.

11. The method of claim 10 wherein said ethylene-vinyl acetate is cross-linked after melt bonding to the extent that the gel content is greater than 15% but less than 90%.

12. The method of claim 1 wherein said higher melting point polymer is polypropylene.

13. The method of claim 1 wherein said higher melting point polymer is polyamide.

14. The method of claim 9 wherein said yarn comprises polypropylene.

15. The method of claim 9 wherein said yarn comprises polyamide.

16. A method for making a melt bonded fabric which comprises blending ethylene-vinyl acetate fibers with fibers of a higher melting point polymer by laying a mat of said ethylene-vinyl acetate fibers upon a needle bonded web of said higher melting point polymer fibers, needle bonding said mat to said web to form a composite web of said blended fibers, and thereafter heating said composite web to a temperature above the melting point of ethylene-vinyl acetate but below the melting point of said higher melting point polymer.

17. The method of claim 16, wherein said ethylene-vinyl acetate fibers have an elastic modulus in the range of 5,000 to 60,000 psi.

18. The method of claim 17, wherein the ratio of ethylene-vinyl acetate fibers to high melting point fibers ranges from 5:95 to 50:50.

19. A fabric made by the method of claim 1.

20. A fabric made by the method of claim 16.

21. The method of claim 16 wherein said higher melting point fiber is polypropylene.

22. The method of claim 16 wherein said higher melting point fiber is polyamide.

23. The method of claim 16 wherein the vinyl acetate content of said ethylene-vinyl acetate is in the range of 5 to 20%.

24. The method of claim 23 wherein said ethylene-vinyl acetate is cross-linked after melt bonding to the extent that the gel content is greater than 15% but less than 90%.

25. A melt bonded fabric comprising a blend of fused ethylene-vinyl acetate fibers with unfused fibers of a higher melting point polymer, said ethylene-vinyl acetate fibers having an elastic modulus in the range of 5,000 to 60,000 psi, said fabric having a surface comprised of said blend and being tufted with yarn to form a fabric face.

26. The fabric of claim 25 wherein the ratio of ethylene-vinyl acetate fibers to higher melting point fibers ranges from 5:95 to 50:50.

27. The fabric of claim 26 wherein said higher melting point fiber is selected from the group consisting of polypropylene, polyamide and mixtures thereof.

28. The fabric of claim 26 wherein said higher melting point fiber is polypropylene.

29. The fabric of claim 26 wherein said higher melting point fiber is polyamide.

30. The fabric of claim 25 wherein said yarn comprises fibers of a higher melting point polymer selected from the group consisting of polyamide, polypropylene and mixtures thereof.

31. The fabric of claim 25 wherein said yarn is polyamide.

32. The fabric of claim 25 wherein said yarn is polypropylene.

33. The fabric of claim 26 wherein the vinyl acetate content of said ethylene-vinyl acetate is in the range of 5 to 20%.

34. The fabric of claim 33 wherein said ethylene-vinyl acetate is cross-linked after melt bonding to the extent that the gel content is greater than 15% but less than 90%.

* * * * *